US006849032B2

(12) United States Patent
Chu

(10) Patent No.: US 6,849,032 B2
(45) Date of Patent: Feb. 1, 2005

(54) EXERCISE APPARATUS SIMULATING SKATING MOTIONS

(75) Inventor: Yong S. Chu, Glendale, CA (US)

(73) Assignee: Fitness Botics, Inc., Van Nuys, CA (US)

( * ) Notice: Subject to any disclaimer, the term of this patent is extended or adjusted under 35 U.S.C. 154(b) by 71 days.

(21) Appl. No.: 10/301,383

(22) Filed: Nov. 20, 2002

(65) Prior Publication Data

US 2004/0097335 A1 May 20, 2004

(51) Int. Cl.[7] ..... A63B 69/18; A63B 21/00
(52) U.S. Cl. ..... 482/51; 482/71
(58) Field of Search ..... 482/148, 63, 51–57, 482/79–80, 70–71

(56) References Cited

U.S. PATENT DOCUMENTS

| | | | | | |
|---|---|---|---|---|---|
| 4,340,214 | A | | 7/1982 | Schutzer | |
| 4,781,372 | A | | 11/1988 | McCormack | |
| 4,869,496 | A | | 9/1989 | Colombo | |
| 4,915,373 | A | | 4/1990 | Walker | |
| 5,284,460 | A | | 2/1994 | Miller et al. | |
| 5,342,264 | A | | 8/1994 | Gordon | |
| 5,391,130 | A | | 2/1995 | Green et al. | |
| 5,451,194 | A | | 9/1995 | Harrigan | |
| 5,520,598 | A | | 5/1996 | Little | |
| 5,595,554 | A | * | 1/1997 | Maresh | 482/52 |
| 5,692,995 | A | | 12/1997 | Alvarez et al. | |
| 5,718,658 | A | * | 2/1998 | Miller et al. | 482/71 |
| 6,042,511 | A | | 3/2000 | Bulloch | |
| 6,106,442 | A | * | 8/2000 | Tissue | 482/71 |
| 6,231,484 | B1 | * | 5/2001 | Gordon | 482/71 |
| 6,234,935 | B1 | * | 5/2001 | Chu | 482/51 |

* cited by examiner

*Primary Examiner*—Stephen R. Crow
(74) *Attorney, Agent, or Firm*—Gene Scott; Patent Law & Venture Group

(57) ABSTRACT

A pair of a skater foot supports are joined with a skating motion director including, a simple crank interconnected with the foot supports by a pivotal linkage, such that as the crank rotates in a circle, one of the foot supports is pulled and the other pushed during a first one-half of the circle rotation, while, the reverse occurs during the second one-half of the circle rotation. The crank is rotationally engaged with a flywheel through a mechanical drive train, enabling the flywheel to rotate at a speed greater than that of the crank whereby the foot supports move with a skating motion for exercising a skater.

8 Claims, 3 Drawing Sheets

EXERCISE APPARATUS SIMULATING SKATING MOTIONS

BACKGROUND OF THE INVENTION

INCORPORATION BY REFERENCE

Applicant(s) hereby incorporate herein by reference, any and all U.S. patents, U.S. patent applications, and other documents and printed matter cited or referred to in this application.

1. Field of the Invention

This invention relates generally to exercise machines and more particularly to such an exercise machine providing skating motions for physical workout and exercising.

2. Description of Related Art

The following art defines the present state of this field:

Schutzer, U.S. Pat. No. 4,340,214 describes a training apparatus for skaters consisting of a fixed training stand with two carriages transversely displaceable in opposite directions, the displacement of which is controlled. Each carriage has a platform for the attachment of one of the skater's feet, said platform altering its angle of inclination upon displacement of the associated carriage from the initial position in the same way as a skate when cutting the ice. The lateral displacement of each carriage occurs against the action of a force which is adjustable.

McCormack, U.S. Pat. No. 4,781,372 describes an ice-skating leg exercise device utilizing in one embodiment a pair of rotatably positionable tracks each having a stirrup movable back and forth thereon in which the user's legs are positioned, each track being angularly adjustable with adjustable weight resistance provided against the rearward movement of each stirrup and a body support for the user to rest there against while exercising his legs on the device.

Colombo, U.S. Pat. No. 4,869,496 describes a piece of equipment for the simulation of skiing movements which comprises a basic structure which can be stably placed on the ground. An arm is hinged to the basic structure in a median position and is able to oscillate horizontally. The arm carries a pair of boards at its end. Feet are connected to the structure to incline it with respect to the ground. The arm is able to carry out a slight vertical oscillation. The boards are restrained to the arm so that they can rotate around their vertical and horizontal axes, the rotation around the vertical axis being limited by suitable means. Two rods overhang and are connected to the arm by pins. The rods are able to rotate around the vertical axis of these pins, such rotation being made synchronous with that of the boards. The rotation is opposite to the direction of oscillation of the arm. The piece of equipment is also equipped with an electrical detection circuit which detects correct or incorrect movements carried out by the user who, by placing his or her feet on the boards and gripping the rods, gives an oscillating movement to the arm with the help of elastic devices which absorb and give back the kinetic energy produced, thus carrying out the movements required by skiing techniques.

Walker, U.S. Pat. No. 4,915,373 describes a power skating exercise device includes a pair of endless guide tracks, each of which have a power section and a return section and a pedal for each guide track. The pedal is mounted on a follower which is slidably mounted in one of the guide tracks. The follower is proportioned to pass freely along the return section. Drag is applied to the follower as it is driven along the drive section to resist the movement of the follower. A support frame is provided for supporting the user in a forwardly inclined semi-prone position which corresponds to the position assumed by a skater when accelerating forwardly.

Miller et al., U.S. Pat. No. 5,284,460 describes an apparatus and method for skate training exercise comprising arms of relatively long length pivotally mounted on a frame. The user's foot is secured in a stirrup on the arm opposite the pivot point. A resistance means is provided to provide resistance as the user pushes his foot away from the body along an arcuate path defined by the arm in simulated skating stroke. A return means is provided to assist the user in returning his foot along the arcuate path after predetermined angle is traversed. Various resistant means include electromagnetic, fly wheel-fan and weight stack.

Gordon, U.S. Pat. No. 5,342,264 describes an aerobic exercise device which provides for a smooth, natural, orbital continuous motion of the user's feet. This device can be used for walking, running, jogging or stair-stepping exercises. Upper body workout devices can be provided with the aerobic exercise device such that a total body workout can be had. The device includes two parallel tracks with platforms. The platforms reciprocate along the tracks. A device is provided in each track for returning the platforms to the home position. As a user operates the device, he or she will push the platforms rearwardly. When the user's foot reaches the end of his or her stride, the user can then lift their foot in a natural motion. The device will return the platform to the home position. As the platform is returning to the home position, it will first travel in a forward direction and then switch to a rearward direction. This rearward movement will enable comfortable planting of the user's foot as it reengages the platform. The device can be easily accommodated to any desired workout level or to many different sized users.

Green et al., U.S. Pat. No. 5,391,130 describes an exercise apparatus used for leg exercises, and particularly for exercising the muscles used in ice skating. The apparatus has a frame with two four bar linkages arranged side by side. Each linkage carries a foot pad. A resistance unit is attached to each linkage to resist movement of the linkage in both directions. The resistance unit is preferably a double acting hydraulic cylinder connected to variable flow control valves to vary the resistance to linkage movement.

Harrigan, U.S. Pat. No. 5,451,194 describes a roller skate exercise device which consists of a platform having a top surface to support a pair of roller skates worn by a person. Components are for permitting the roller skates to slide in opposed reciprocating motions on the top surface of the platform, so as to simulate cross country skiing.

Little, U.S. Pat. No. 5,520,598 describes a combination leg exercise device, including: a base member; two, elongate, parallel plates attached to rotating apparatus mounted on the base member; and support apparatus disposed at distal ends of the plates to accommodate thereon selected weights; such that a person standing on the plates, with a foot disposed over each of the rotating apparatus, moves the weights between a first, lowered position and a second, elevated position by alternatingly flexing and relaxing muscles in the person's lower legs; the device further including: two track assemblies extending horizontally from the base member; and the track assemblies including thereon two wheeled platforms; such that a person standing with a foot on each of the platforms, slides the platforms back and forth along the track assemblies by alternatingly flexing and relaxing inner and outer muscles in the person's upper legs.

Alvarez et al, U.S. Pat. No. 5,692,995 describes an exercise machine that simulates the movements made during snow skiing and has a pair of foot support arms mounted for limited rotational movement about separate axes of rotation so that foot support portions of the foot support arms move simultaneously both vertically and horizontally, coordinates simultaneous movement of both foot support arms through a gear train coupling the foot support arms. In addition, foot support treads which support the feet of a user of the machine are resiliently mounted to the foot support arms to allow angling of the foot support treads to simulate a feeling of edging of skis.

Miller et al., U.S. Pat. No. 5718,658 describes an apparatus and method for skate training exercise comprising arms of relatively long length pivotally mounted on a frame. The user's foot is secured in a stirrup on the arm opposite the pivot point. A resistance means is provided to provide resistance as the user pushes his foot away from the body along an arcuate path defined by the arm in simulated skating stroke. A return means is provided to assist the user in returning his foot along the arcuate path after predetermined angle is traversed. Various resistant means include electromagnetic, fly wheel-fan and weight stack.

Bulloch, U.S. Pat. No. 6,042,5131 teaches an exercise, training and conditioning apparatus for skaters which includes a pair of movable foot platforms that are guided along a pair of coupled track sections, and a latching mechanism that alternatively secures and releases one of the pair of foot platforms while releasing and securing another one of the pair of foot platforms. According to one embodiment, the pair of track sections are coupled together at 90.degree. Resistance to movement is applied to the pair of foot platforms by elastic or inelastic cables.

Chu, U.S. Pat. No. 6,234,935 teaches a skating training apparatus includes rotating gears positioned in a generally horizontal plane. Linear supporting struts are pivotally attached to the gears for movement therewith and a motion restricting device is engaging with the liner supporting struts and adapted for restricting the linear supporting struts to a combination of pivotal and linear translational motion. Pivots engage the linear supporting struts and restrict it to pivotal motion at one end. Foot rests are mounted on the linear supporting struts at an end opposite to the pivots. The rotating gears, linear supporting struts, motion restricting device and pivots are mutually interconnected for moving the foot rests in a skating motion as driven by a person's feet while training on the apparatus.

The prior art teaches physical training machines for a wide range of muscle development and for training endurance. Chu, '935, the inventor of the present skating exercise device, teaches a skating exercise machine with considerable complexity and cost when compared to the present invention. The prior art does not teach a machine of simple and inexpensive construction capable of true skating motion. The present invention fulfills this need and provides further related advantages as described in the following summary.

SUMMARY OF THE INVENTION

The present invention teaches certain benefits in construction and use which give rise to the objectives described below.

Skating requires a side-to-side motion which up until now has been difficult to reproduce in a simple and inexpensive exercise machine. See my previous attempt described above in U.S. Pat. No. 6,234,935. However, I have now devised a much simplified and improved manner for providing skating motion in an exerciser that may be manufactured at low cost and is much more reliable. In the present invention a pair of a skater foot supports are joined with a skating motion director including, a simple crank interconnected with the foot supports by a pivotal linkage, such that as the crank rotates in a circle, one of the foot supports is pulled and the other pushed during a first one-half of the circle rotation, while, the reverse occurs during the second one-half of the circle rotation. In this way, the supports move in alternating arc motions from side to side simulating skating movements of the skater's feet. The foot supports are mounted at an angle so that each support moves to an elevated position when it swings to the inside lateral position. The crank is rotationally engaged with a flywheel through a mechanical drive train, enabling the flywheel to rotate at a speed greater than that of the crank whereby the foot engaging means move with a skating motion for exercising a skater and this motion is smoothed using the flywheel's energy. A handle moves from side-to-side coordinated with the foot supports so that the skater may maintain balance. Such a machine has the advantage of exercising the entire body, legs and arms without jarring actions, in a highly smooth and fluid motion that is soothing as well.

A primary objective of the present invention is to provide an apparatus and method of use of such apparatus that provides advantages not taught by the prior art.

Another objective is to provide such an invention of simple design and manufacture.

A further objective is to provide such an invention enabling true skating motion.

A still further objective is to provide such an invention with variable resistance adjustment.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention. In such drawings.

DETAILED DESCRIPTION OF THE INVENTION

The above described drawing figures illustrate the invention in at least one of its preferred embodiments, which is further defined in detail in the following description.

Figure 1:
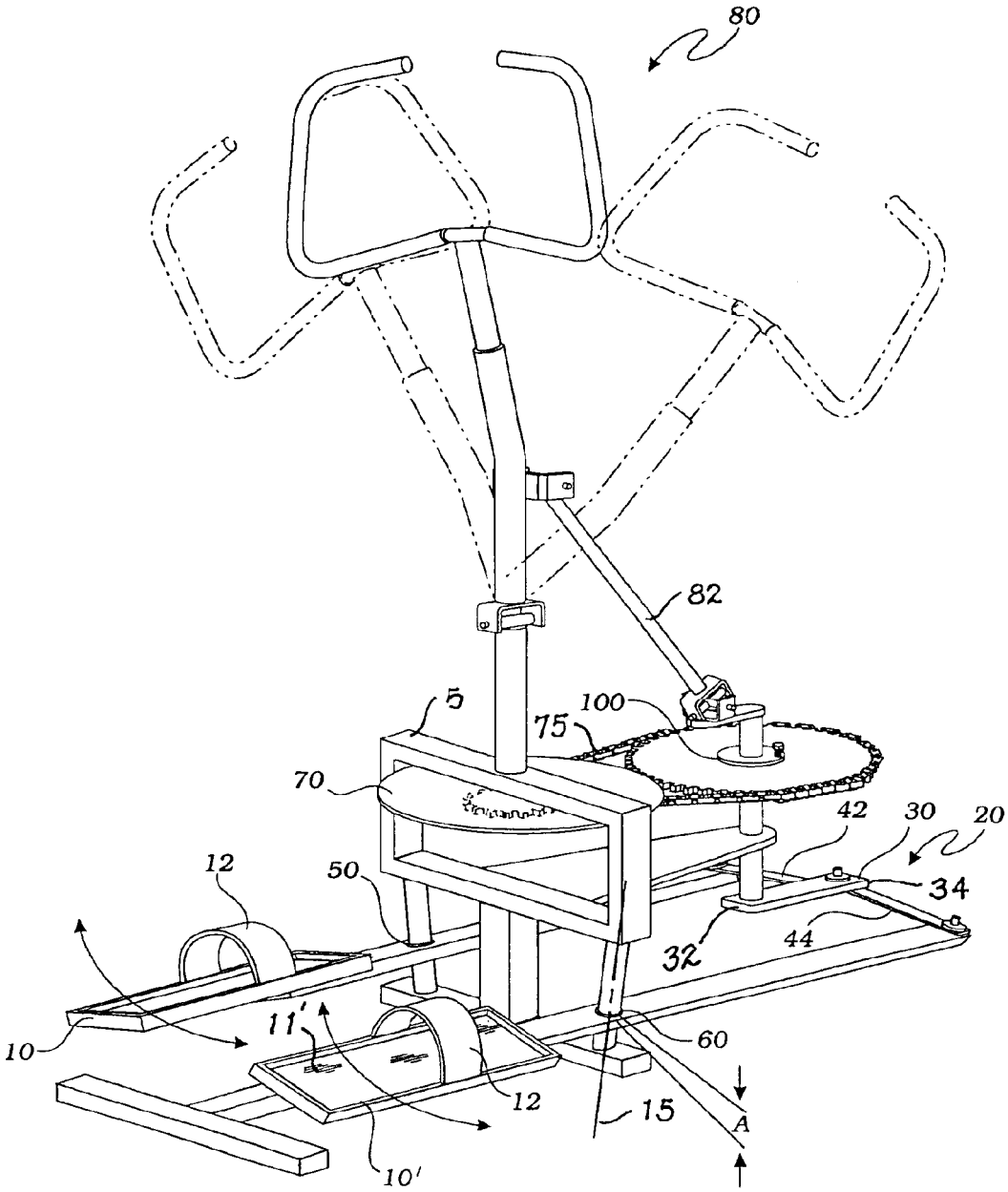
FIG. 1 is a perspective view of the preferred embodiment of the invention.
Figure 2:
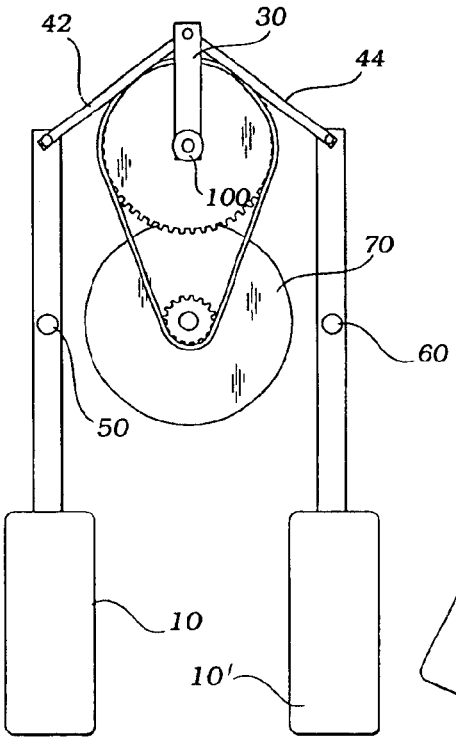
FIGS. 2–4 are bottom plan views thereof showing the invention in three stages of manipulation according to how it is used in practice.

The present invention is a skating motion exercise apparatus comprising a pair of a means for engaging a foot 10, 10' of a skater, and a means for directing skating motion 20 to the pair of foot engaging means 10, 10'. The foot engaging means 10, 10' are each preferably a treadle of such size and shape as to accommodate a foot of the skater and may include a strap for engaging the foot securely to the treadle, while allowing the heel of the foot to lift off the treadle. This may be a simple instep strap 12 as shown in FIG. 1, or a toe cup, both of which are well known in the prior art. The foot engaging means 10, 10' further include rigid rods 11. The skating motion directing means 20 includes, a means for cranking 30, which may be a simple crank system as clearly shown in FIG. 1, interconnected with the pair of foot engaging means 10, 10' by a pivotal means for linking, i.e., the pair of links 42, 44 shown in FIG. 1, such that as the cranking means 30 rotates in a circle, one of the foot engaging means 10 is pulled during a first one-half of the circle of rotation, while, simultaneously, the other of the foot engaging means 10' is pushed, and during a second one-half of the circle of rotation, the other of the foot engaging means 10' is pulled, while simultaneously, the one of the foot engaging means 10 is pushed. The foot engaging means 10, 10' is pivotally mounted at points 50 and 60 for simple arcuate reciprocating motion as shown by the arrows in FIG. 1. The cranking means 30 is rotationally engaged with an energy storing means 70 enabled for smoothing the motion of the cranking means 30 as the cranking means 30 rotates, driven by the pair of foot engaging means 10, 10'.

Preferably, the energy storing means 70 is a flywheel mounted for rotation and enabled by a drive train 75 to rotate at a speed greater than that of the cranking means 30. In FIG. 1 it is shown that a preferred manner of accomplishing this is to drive the means 70 by a chain or belt with a rotational ratio of at least several turns of flywheel 70 to each rotation of the cranking means 30 as shown.

Preferably, as shown in FIG. 1, the foot engaging means 10, 10' are each mounted at an angle such that when one of the foot engaging means 10 moves toward an outboard lateral position, during the alternating lateral movements of the foot engaging means, the other one of the foot engaging means 10' moves toward an elevated inboard lateral position, and visa-versa. This improves the ability of the skater to shift weight and improves the simulation of skating motion. As shown in FIG. 1 the mounting angle is defined by angular dimension "A" below the horizontal.

Figure 3:
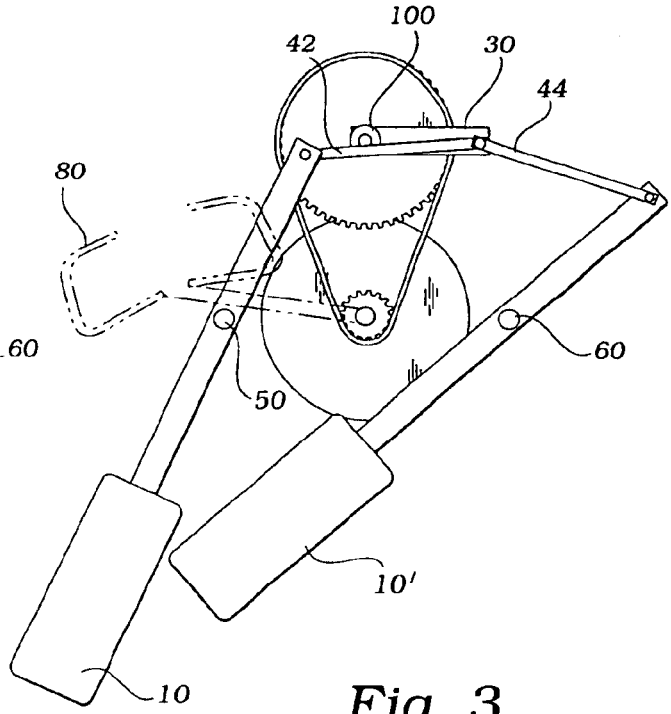
Figure 4:
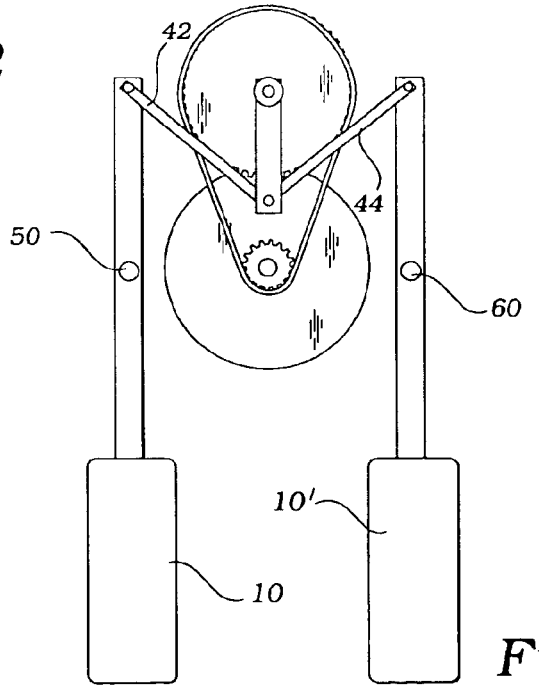

Preferably, an upright handle 80 is engaged with the cranking means 30 such that it moves from side-to-side in lateral reciprocating motion. This is accomplished by pivotally mounting the handle 80 and attaching the handle 80 to the axle of the cranking means 30 in such manner that each rotation of the cranking means 30 pulls the handle to the side which extends the treadle to the rear, as shown in FIG. 3.

A friction pad 100 is brought into contact with the cranking means and is adjustable for enabling a range of difficulty in the present invention exerciser. Alternatively, the friction pad 100 may be mounted for contact with the flywheel.

FIGS. 5–8 show alternative linkage arrangements that may be used in the present invention to assure that both foot engaging means move in concert. Other alternate linkage arrangements would be obvious to those of skill in the art.

Further, the present invention may be described as a skating motion exercise apparatus comprising a crank system 20 (also referred to as a skating motion directing means) including a linear crank arm 30 (also referred to as a cranking means) pivoted at a crank arm first end 32 about a fixed frame 5 for circular rotation of a crank arm second end 34. The crank arm second end 34 is mechanically interconnected to a pair of rigid elongate rods 11 by at least one elongate crank link 42. This construction is clearly shown in FIG. 1. Each of the pair of rigid elongate rods 11 provide a foot support 10 and 10' (also referred to as a treadle) at a distal end 11' thereof for supporting a person exercising on the apparatus. Each of the rigid elongate rods 11 are pivotally engaged about a rotational axis 15 relative to the fixed frame 5 such that the foot supports 10 and 10' are forced to move in synchronized, side-to-side cyclic motion. Each of the rotational axes 15 are not vertical so that as the foot supports 10, 10' move in a common horizontal direction, the foot supports move in opposing vertical directions, that is, as both of the foot supports move to the left, the left foot support 10 moves downwardly, while the right foot support 10' moves upwardly. This is clearly illustrated in FIG. 1.

An upright handle 80 is engaged with the crank system 20 by an elongate handle strut 82 such that the upright handle 80 moves in reciprocating, side-to-side motion synchronized with the cyclic motion of the foot supports 10, 10'.

In the embodiment shown in FIGS. 1–4, the two elongate crank links 42, 44 are engaged with the rigid elongate rods 11 such that as the crank arm 30 rotates in a first half of each full rotation, one of the elongate crank links 42 pushes one of the rigid elongate rods 11 while the other one of the elongate crank links 44 pulls the other of the rigid elongate rods 11, thereby causing the rigid elongate rods 11 to pivot about the fixed frame 5 at axes 15. In a second half of each rotation of the crank arm 30, the links 42 and 44 reverse roles.

Figure 5:
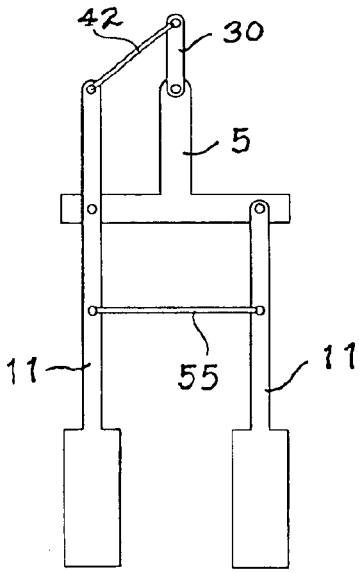
FIGS. 5–8 are schematic diagrams of alternative linkage interconnections thereof.
Figure 6:
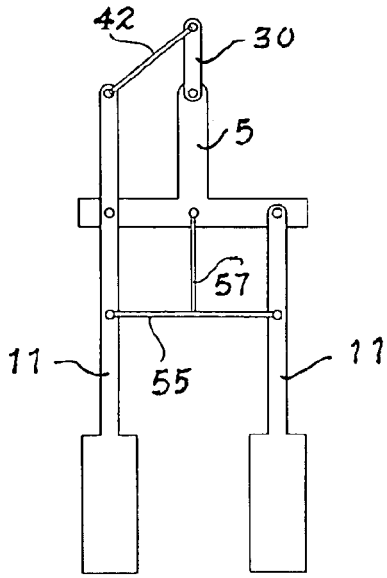

As shown in FIG. 5 crank link 42 is engaged with one of the rigid elongate rods 11, as previously described, and an elongate rod link 55 is engaged between the rigid elongate rods 11 such that as the crank arm 30 rotates, the elongate crank link 42 first pushes and then pulls the left one of the rigid elongate rods II while the elongate rod link 55 pushes and then pulls the right one of the rigid elongate rods 11 to produce synchronized cyclic motion of the rigid elongate rods 11. FIG. 6 shows an alternate embodiment of the scheme of FIG. 5 wherein an intermediate elongate link 57 pivotally joins the elongate rod link 55 medially to the fixed frame 5. As before, all of the interconnections are pivotal joints to allow the rods 11 to move in synchronization.

Figure 7:
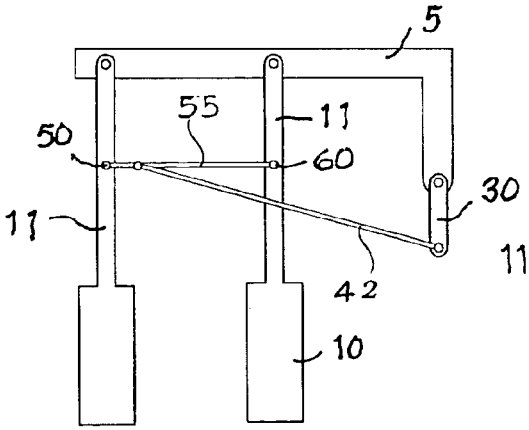
Figure 8:
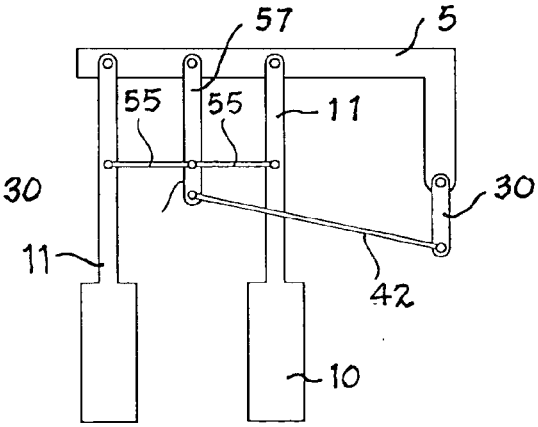

As shown in FIG. 7, the elongate crank link 42 may be joined pivotally to the elongate rod link 55, so that the rods 11 move in synchronization. FIG. 8 shows a further embodiment wherein the elongate crank link 42 is joined with the intermediate elongate link 57 so as to move the rods 11 in synchronization.

While the invention has been described with reference to at least one preferred embodiment, it is to be clearly understood by those skilled in the art that the invention is not limited thereto. Rather, the scope of the invention is to be interpreted only in conjunction with the appended claims and it is made clear, here, that the inventor(s) believe that the claimed subject matter is the invention.

What is claimed is:

1. A skating motion exercise apparatus comprising: a crank system including a linear crank arm (30) pivoted at a crank arm first end (32) thereof about a fixed frame (5) for circular rotation of a crank arm second end (34); the crank arm second end mechanically interconected to a pair of rigid elongate rods (11) by at least one elongate crank link (42); each of the pair of rigid elongate rods providing a foot support at a distal end thereof for supporting a person exercising on the apparatus, each of the rigid elongate rods pivotally engaged about a rotational axis relative to the fixed frame such that the foot supports are forced to move in synchronized, side-to-side cyclic motion.

2. The apparatus of claim 1 wherein the rotational axes are not vertical so that as the foot supports move in a common horizontal direction, the foot supports move in opposing vertical directions.

3. The apparatus of claim 1 further comprising an upright handle engaged with the crank system by an elongate handle strut such that the upright handle moves in reciprocating, side-to-side motion synchronized with the cyclic motion of the foot supports.

4. The apparatus of claim 1 wherein the at least one elongate crank link comprises two elongate crank links, each one of the two elongate crank links engaged with one of the rigid elongate rods such that as the crank arm rotates, one of the elongate crank links pushes one of the rigid elongate rods while the other one of the elongate crank links pulls the other of the rigid elongate rods, thereby causing the rigid elongate rods to pivot about the fixed frame.

5. The apparatus of claim 1 wherein the at least one elongate crank link comprises a single elongate crank link engaged with one of the rigid elongate rods, and further comprising an elongate rod link; the elongate rod link engaged with the rigid elongate rods such that as the crank arm rotates, the elongate crank link first pushes and then pulls the one of the rigid elongate rods while the elongate rod link pushes and then pulls the other of the rigid elongate rods for synchronized cyclic motion of the rigid elongate rods.

6. The apparatus of claim 5 further comprising an intermediate elongate link pivotally joining the elongate rod link medially to the fixed frame.

7. The apparatus of claim 1 wherein the at least one elongate crank link comprises a single elongate crank link, and further comprising an elongate rod link; the elongate crank link pivotally engaged with the elongate rod link such that as the crank arm rotates, the elongate crank link first pushes and then pulls the elongate rod link for synchronized cyclic motion of the rigid elongate rods.

8. The apparatus of claim 7 wherein the at least one elongate crank link comprises a single elongate crank link, and further comprising at least one elongate rod link pivotally joining the rigid elongate rods; the elongate crank link pivotally engaged with an intermediate elongate link pivotal from the fixed frame; such that as the crank arm rotates, the elongate crank link first pushes and then pulls the intermediate elongate link, the intermediate elongate link, in turn, pushes and then pulls the intermediate elongate link for synchronized cyclic motion of the rigid elongate rods.

* * * * *